United States Patent [19]

Ceron

[11] 4,241,504

[45] Dec. 30, 1980

[54] RECORD ALBUM OPENER

[76] Inventor: Jose D. Ceron, 150 W. 72nd St., New York, N.Y. 10023

[21] Appl. No.: 17,011

[22] Filed: Mar. 2, 1979

Related U.S. Application Data

[63] Continuation-in-part of Ser. No. 833,463, Sep. 15, 1977, abandoned.

[51] Int. Cl.[3] ..... B26B 29/00
[52] U.S. Cl. ..... 30/292
[58] Field of Search ..... 30/292

[56] References Cited

U.S. PATENT DOCUMENTS

| | | | |
|---|---|---|---|
| 142,584 | 9/1873 | Rice | 30/292 |
| 636,468 | 11/1899 | Strang | 30/292 |
| 1,281,700 | 10/1918 | Swenson | 30/292 |
| 1,681,667 | 8/1928 | Johnston et al. | 30/292 |
| 1,856,435 | 5/1932 | Schwarz | 30/292 |
| 2,021,275 | 11/1935 | Warner | 30/292 |
| 2,624,936 | 1/1953 | Jensen | 30/289 |
| 2,677,180 | 5/1954 | Schierghofer | 30/292 |
| 3,827,551 | 8/1974 | Croft | 30/286 |

FOREIGN PATENT DOCUMENTS

| | | | |
|---|---|---|---|
| 109889 | 2/1944 | Sweden | 30/292 |

*Primary Examiner*—Othell M. Simpson
*Assistant Examiner*—J. T. Zatarga
*Attorney, Agent, or Firm*—Robert D. Farkas

[57] ABSTRACT

A pocket sized record album opener that is adapted to be held in the hand and contains a recessed cutting edge that slidably engages the cellophane bridge over the open mouth of an album jacket thereby opening the same, all the while, the cutting edge being free of the actual record and the user's hand. In one embodiment, a pair of serrated disk-like cutting wheels are mounted on spaced apart parallel axles such that their lateral surfaces are at different distances from a flat fence-like guide surface. The fence-like guide surface may be moved relative to the position of the pair of serrated disc-like cutting wheels, thereby permitting the apparatus to be utilized in cutting covers, whereby the cuts in the covers to be made vary in distance from the surface on which the fence moves. A cover is pivotably secured to the housing carrying the axle, acting as a cover for the fence-like guiding surface and the exposed portion of the serrated cutting wheels.

6 Claims, 7 Drawing Figures

RECORD ALBUM OPENER

BACKGROUND OF THE INVENTION

This application is a continuation-in-part of prior U.S. application Ser. No. 833,463 filed 09/15/77 now abandoned.

This invention relates to a record album opener; more particularly, to an opener that is adapted to slidably communicate with the cellophane jacket protectively covering the album case and break the seal thereby formed.

The prior art teaches a variety of knife blade openers, for example, as disclosed in U.S. Pat. Nos.: 2,649,656; 3,068,569; 3,012,335; 3,383,768; 3,432,926; 3,639,983; 3,678,581; 3,791,014; and others. None of the foregoing, are however, suitable for the delicate job of opening a record album due to the placement of the knife blade and the fact that the entire structure is not suitable for engagement with the cellophane bridge covering the open mouth of the album cover.

SUMMARY OF THE INVENTION

It is accordingly an object of the instant invention to provide for an improved cutting tool adapted to open record albums.

It is a further object to provide for a cutter wherein the cutting edge does not contact the record itself.

It is another object to provide for the above at relatively little cost thereby making it generally available.

These and other objects and advantages of the invention will become more apparent from the following detailed disclosure and claims and by reference to the accompanying drawings, in which:

Figure 1:
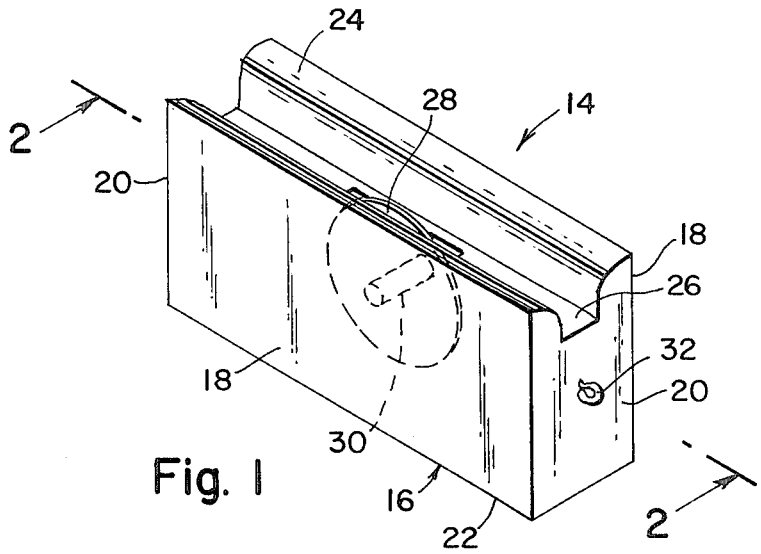
FIG. 1 is a perspective view.
Figure 2:
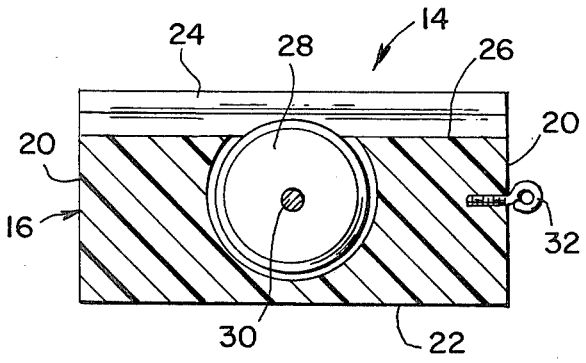
FIG. 2 is a sectional view taken along the line 2—2 of FIG. 1.
Figure 3:
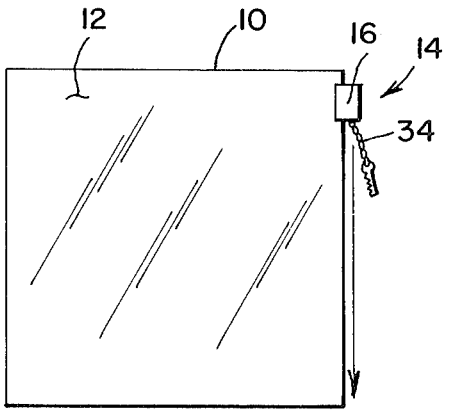
FIG. 3 is a side elevational view of a record album showing the device in operation.
Figure 4:
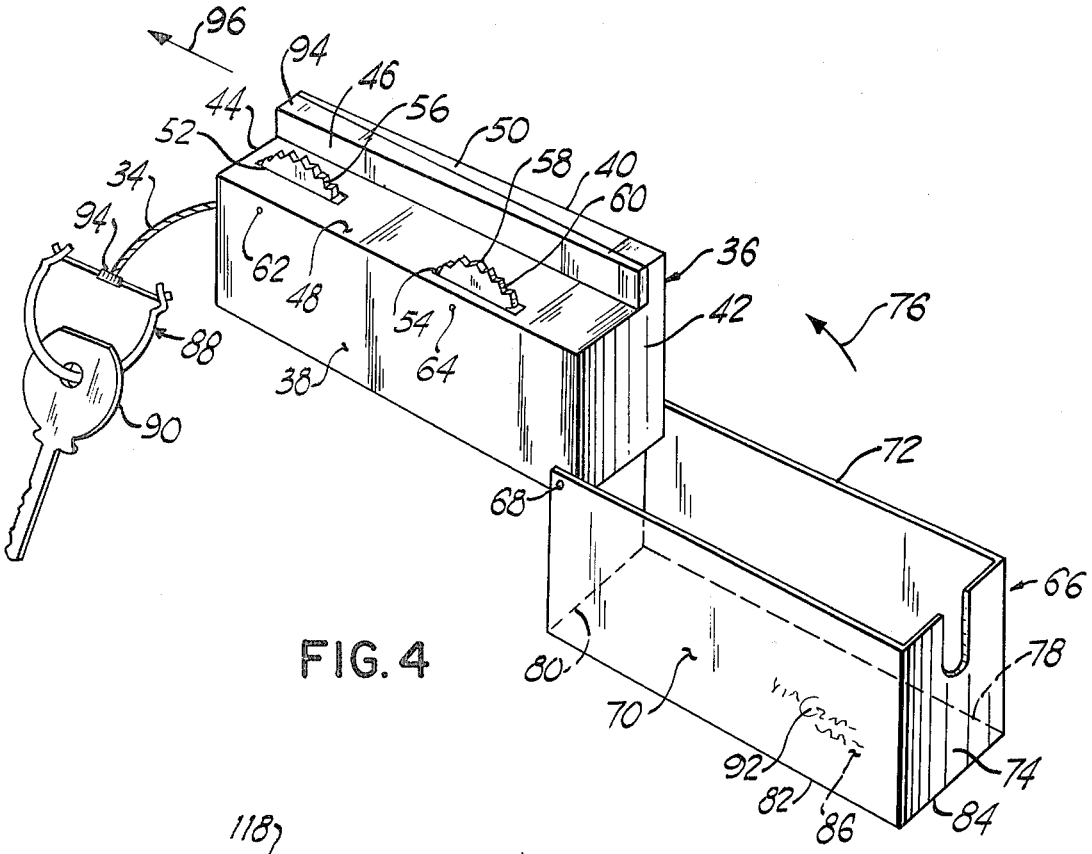
FIG. 4 is an alternate embodiment of the present invention.
Figure 5:
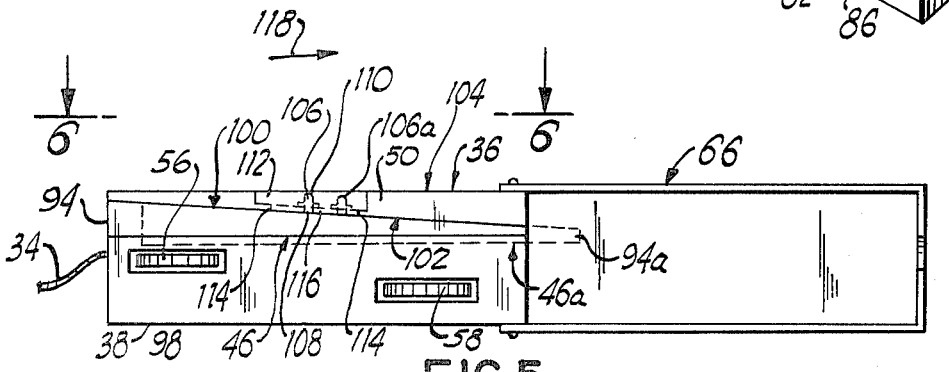
FIG. 5 is a plan view of a portion of the embodiment illustrated in FIG. 4.
Figure 6:
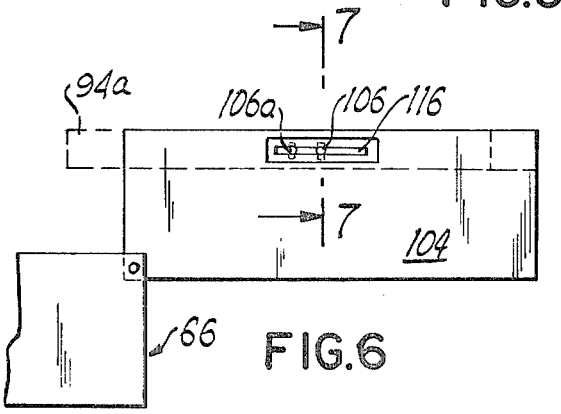
Figure 7:
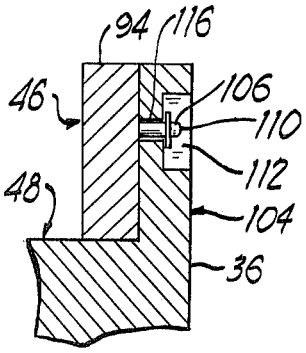

FIG. 6 is a side elevation view, taken in the direction of arrows 6—6, as shown in FIG. 5; and FIG. 7 is a partial side elevation cross-sectional view, shown in the direction of arrows 7—7, along line 7—7, as shown in FIG. 6.

Broadly speaking, the instant invention includes the provision of a device for cutting the protective covering over a mouth of a record jacket, comprising a walled body serving as a handle and including a pair of opposing side walls and end walls, a longitudinal open channel defined between the side walls, circular blade means housed in the body, the blade means journalled for rotation about shaft means, the shaft means disposed in a cavity in the body and communicating between the side walls, the channel having a base portion defining an aperture for receipt and exposure of the cutting edge of the blade means, the channel having an internal width at least as large as the thickness of a record album.

In another embodiment, a rectangular wall body is provided having a fence-like rail disposed extending outwardly from one marginal edge of the apparatus. A pair of open channels are defined extending downwardly into the body, each running parallel with a guiding surface of the projection parallel to the longitudinal edges of the channel. The channels provide access to a pair of circular serrated blades journalled within the cavities disposed below the channels having a pair of axle means which are spaced apart and parallel extending perpendicularly to the longitudinal axis of the protrusion. The channels, or open mouth portions of the cavities, are spaced apart from the guiding surface so as to permit the circular blades to effectively cut into wrappings on a single record album having two lateral rigid surfaces in juxtaposed relationship, three lateral surfaces comprising a double album record album, such that both cutting wheels span the center rigid element of such an album and other packages having bulbous like wrappings. When not in use, a four sided-cover is pivotably secured to the body utilizing an axle extending parallel to the pair of axles carrying the circular blade such that when the cover element is pivoted back on its axle, the exposed portion of the circular blades extending outwardly from the surface carrying the cavity's open mouth portion, are covered and protected from damage and prevents the blades from accidentally contacting other devices contacting such blades. A key-chain, well known in the art, is secured to an end of the body opposite the end adjacent the location the axle carrying the cover. The other end of the chain, preferably flexible in nature, carries a key ring upon which keys or other objects may be threaded. The apparatus may be decorated, if desired, by indicia located on the cover so as to simulate a miniature book. The binding of the "book" is a portion of the cover, whilst the body itself may be grooved so as to simulate the pages of a book. The protrusion and the surface carrying the open mouth portions of the cavities are disposed adjacent the spine of the book-like decorated cover.

I have discovered that many contemporary double record albums jacket width have a total thickness between four and five m.m., and single record albums measure in the range of two to three m.m. Thus, by having the open mouth portion closest to the adjacent wall-like surface of the protrusion extending some one m.m. away, and with second open mouth portions extending some four m.m. away from the guiding surface, and both open mouth portions being parallel to each other and the guiding surface, the apparatus is effective for opening up single record albums jackets as well as double record album jackets. This is accomplished very effectively when the diameter of each of the circular blades are ten m.m. and each having serrations extending inwardly one m.m. The height of the protrusion is preferably 3 m.m. above the surface carrying the open mouth portions of the cavity and measures two m.m. thick. Each cavity is disposed having a diameter of eleven m.m. and is provided having a width of approximately 1 m.m., housing therewithin a suitably dimensioned serrated circular blade. The overall dimension of the body, that has proven effective for practical use, as by being carried about in one's pocket and effective for opening up packages of the type described, is a body having a length of 35 m.m. and a thickness of 8 m.m. with a height of 20 m.m. high. The outside dimensions of the cover are adapted to closely follow the overall dimensions of the body carrying the pair of circular blades.

The fence-like rail has an operable surface which is disposed adjacent the nearest serrated blade. Such operable surface may be moved closer to or further from such closest serrated blade, while remaining parallel to the closest lateral surface of the closest blade. This is accomplished, in the preferred mode, by utilizing a wedge-shaped bar having the fence rail-like surface thereon, in sliding engagement with a wedge-shaped protrusion, extending upwardly from the surface in which the channels extend. By sliding the wedge-shaped rod in the direction of the planar surfaces of the serrated blades, the fence-like surface may be disposed closer or further from the nearest lateral surface of the closest serrated blade.

DESCRIPTION OF THE PREFERRED EMBODIMENT

Referring more particularly to the drawings, there is shown a conventional record album that includes a cardboard jacket 10 having an open mouth and a covering of cellophane 12 or like material thereover to protect the record and prevent the same from slipping out of the open mouth of the jacket 10. The instant device 14 includes a body portion 16, having side walls 18, end walls 20, a base portion 22, a top portion 24 that is an extension of the side walls 18 and defines therebetween an open channel 26 housing a circular blade 28. The body 16 defines at least a hollow cavity or chamber therein for receiving the blade 28. The blade 28 is recessed or set in, such that only about 1 m.m. of the blade protrudes out into the open channel 26, i.e., above the floor thereof. The blade 28 is mounted for rotation about a shaft 30, which generally communicates between the two opposing side walls 18.

It should be noted that the channel 26 is rectangular in cross-section and is formed between the side 18 and end 20 walls. The width of the channel 26 is slightly greater than the (thickness) distance from outer surface to outer surface across the mouth of the jacket 10. The interior surface of the top portion 24 is suitably beveled or rounded so as to prevent damage to the jacket 10 and provide for ease of introduction of the jacket 10 into the channel 26.

If desired, one end wall 20 may be provided with means 32 such as an eyelet or the like to receive chain or strap means 34 so that the device 14 may be hung when not in use or carried on a key chain or the like. The entire structure is preferably about 1/100 the size of a record jacket, i.e., it is a mini device having an extremely small (micro) cutting blade. The blade 28 can neither contact the record itself nor the user's fingers when the device is in operation or at rest.

An alternate embodiment shows the apparatus 36 having opposite walls 38 and 40. End walls 42 and 44 extend some 35 m.m. apart. Surface 46, located on rod 94, extends perpendicular to surface 48 and transverse to end walls 42 and 44. Bar 50 comprises a wedge-like protrusion extending over surface 48. Wedge-shaped rod 94 is equivalent in length to the length of bar 50 such that surface 46 as well as the width of wall 40 have the same length when rod 94 is in the position shown. When rod 94 is moved in the direction of arrow 96, then the distance separating surface 46 from the closest wheel, wheel 56, will increase. Alternately, when rod 94 is moved in the direction opposite to arrow 96, then, surface 46 will move closer to wheel 56, permitting the apparatus 36 to be utilized to cut a cover, not shown, whose cut lines should be closer to the edge of the cover, when rested against surface 46. Thus, as can be seen, apparatus 36 may be adjusted so as to produce two cut lines, each fixedly spaced from one another, but both being variably spaced from a reference point on a side of the product to be cut. Surface 48 is shown provided having openings 52 and 54 therein. Such openings have circular blades 56 and 58 extending outwardly therefrom, in part, each being provided with pointed protrusions 60. It should be noted that the elongated marginal edges of openings 52 and 54 extend at different distances from surface 46. Openings 52 and 54 communicate to cavities, not shown, housing the remaining portions of circular blades 56 and 58. Axles 62 and 64 extend from wall 38 through to wall 40 and are spaced apart from one another, as well as being parallel to one another. Axles 62 and 64 carries wheels 56 and 58 thereon. Wheels 56 and 58 are each disposed at different distances from surface 46, each being free to rotate freely on either counterclockwise or clockwise direction. Cover 66 is shown secured suitably to axle 68. Axle 68 extends through wall 38 and 40 so as to engage sheets 70 and 72 of cover 66. Sheet 74, of cover 66 will reside covering wall 44, of body 36, when sheet 74 is pivoted upwardly in the direction of arrow 76. Dotted lines 78 and 80, as well as solid lines 82 and 84, define a surface 86, which covers surface 48 and bar 50, as well as rod 94, when sheet 74 is rotated in the direction of arrow 76. Key ring 88 is shown disposed at end 94 of chain or strap means 34 and is useful, in retaining key 90 thereon in conventional fashion. Body 36 may be fabricated from a plastic-like material, such as a phenol-like compound or polypropylene. Cover 66, may be fabricated from a metallic material, such as steel. Axles 62, 64, and 68 may each be fabricated from a metallic material such as brass, whilst circular blades 56 and 58 may be fabricated from a hard tempid steel-like material. Surface 86 may be crowned if desired, so as to have the flat lowermost surface thereof, in a convex shape, that extends outwardly from sheets 70 and 72 and away from dotted line 78 and solid line 82. Indicia 92 is shown on an outermost surface of cover 66.

FIG. 5 illustrates rod 94 having wedge shaped surface 100 thereof shown located at an angle relative to surface 46, thereby producing a wedge-shaped rod. Surface 102 of protrusion 50 is shown extending opposite surface 104 of protrusion 50, so as to provide a wedge shaped surface for the protrusion. Pin 106 shown in solid lines, extends so as to have end 108 thereof secured to rod 94. It should be noted that pin 106 has end 110 thereof residing in cavity 112, shown in dotted lines. Dotted lines 114 illustrate the extremes for an elongated passageway 116, in which the dotted portions of pin 106 reside. A fingernail, not shown, placed on end 110 of pin 106, and exerting a force so as to move pin 106 in the direction of arrow 118, permits rod 94 to move in a direction of the dotted lines simulating the new position for rod 94, denominated **94*a*. When rod 94*a* is in the position shown, surface 46*a* thereof is closer to surface 98 of serrated wheel 56. In such position, pin 106 is moved in the position shown by dotted lines 106*a*. In the event it is desired to increase the distance separating surface 46, from surface 98, then, pin 106, in similar fashion, may be moved in the direction opposite to arrow 118. In any event, as desired, rod 94 should be sensibly located in the position shown in solid lines, in order to close cover 66**.

FIG. 6 illustrates passageway 116 in which pin 106 resides, and along whose length pin 106 may move, and as shown in the position denominated by numeral **106*a*. As shown in FIG. 6, cover 66 is partially shown and extends outwardly from, and covering a part of, surface 104**.

FIG. 7 illustrates elongated passageway 116, shown intermediate opening 112 wherein opening 112 is made sufficiently large so as to provide manual access to end 110 of pin 106.

Since it is obvious that numerous changes and modifications can be made in the above-described details without departing from the spirit and nature of the invention, it is to be understood that all such changes and modifications are included within the scope of the invention.

I claim:

1. A device for cutting the protective covering over the side walls of an object, comprising a rectangularly shaped body serving as a handle and including a pair of opposed side walls and end walls, a pair of cavities disposed between said opposed side walls, a pair of open mouth portions communicating with said pair of cavities, said pair of open mouth portions located in an upper surface of said body, said upper surface carrying an elongated protrusion thereon, said protrusion extending parallel to one of said side walls and communicating with said opposed end walls, said protrusion having a guiding surface normal to said upper surface, said guiding surface extending substantially upwardly from said upper surface, a pair of parallel spaced apart axles, said pair of axles extending normal to said opposed side walls and passing through said pair of cavities, a pair of circular cutting blades, said pair of cutting blades carried by said pair of axles, a portion of said pair of circular cutting blades extending outwardly from said upper surface and through said open mouth portions, each of said cutting blades spaced apart from said guiding surface, each of said cutting blades spaced apart a fixed distance from one another, a cover, another axle, said another axle spaced apart and parallel to said pair of axles, said another axle extending outwardly from said side walls, said cover pivotably secured to said another axle adjacent the ends thereof, said cover having a pair of opposed side surfaces disposed parallel to said opposed side walls, said cover having another surface thereof extending transverse to both said pair of surfaces, whereby said another surface covers said protrusion and said upper surface and said portion of said pair of circular cutting blades when said cover is pivoted about said another axle, said another axle being located adjacent one of said end walls and adjacent a bottom wall of said body disposed opposing said upper surface, means for selectively positioning said guiding surface at different distances from one of said each of said cutting blades while at all times maintaining the guiding surface parallel to the plane of said blades, said means for selectively positioning including a bar, said bar fixedly secured to said rectangularly shaped body, said protrusion including a rod, said rod slidably affixed to said bar, said rod carrying said guiding surface thereon, said bar and said rod having mating surfaces, said mating surfaces residing in a plane extending at an acute angle to a plane defining said guiding surface.

2. The apparatus as claimed in claim 1 further comprising said cover having an end wall-like surface, said end wall-like surface extending to said pair of side surfaces and said another surface.

3. The apparatus as claimed in claim 1 wherein said pair of circular blades have serrated marginal edges.

4. The apparatus as claimed in claim 1 wherein said protrusion extends outwardly from said upper surface a greater distance than said portion of said pair of circular cutting blades.

5. The apparatus as claimed in claim 1 further comprising a pin, one end of said pin fixedly secured to said rod, a portion of said pin passing through an elongated passageway located in said bar.

6. The apparatus as claimed in claim 1 wherein the length of said bar is equal to the length of said rod.

* * * * *